US006244989B1

(12) United States Patent
Chen

(10) Patent No.: US 6,244,989 B1
(45) Date of Patent: Jun. 12, 2001

(54) LEG SWING EXERCISER FOR A WALKER

(76) Inventor: Chien-Liang Chen, No. 9, Lane 137, Sec. 2, Nantun Rd., Nantun Dist., Taichung (TW)

( * ) Notice: Subject to any disclaimer, the term of this patent is extended or adjusted under 35 U.S.C. 154(b) by 0 days.

(21) Appl. No.: 09/492,279

(22) Filed: Jan. 27, 2000

(51) Int. Cl.[7] ..... A63B 22/00
(52) U.S. Cl. ..... 482/57; 482/127
(58) Field of Search ..... 482/57, 63, 121, 482/127, 122, 126, 129, 130, 133, 72, 904

(56) References Cited

U.S. PATENT DOCUMENTS 1,324,404 * 12/1919 Metzger ..... 482/127
3,759,512 * 9/1973 Yount et al. ..... 482/57
5,470,297 * 11/1995 Park ..... 482/127
5,618,247 * 4/1997 Perez ..... 482/904
5,690,598 * 11/1997 Liang ..... 482/127
5,722,917 * 3/1998 Olschansky et al. ..... 482/72
5,833,575 * 11/1998 Holslag ..... 482/51

* cited by examiner

*Primary Examiner*—Stephen R. Crow
(74) *Attorney, Agent, or Firm*—McDermott, Will & Emery

(57) ABSTRACT

A leg swing exerciser for a walker includes a support bar with a threaded hole defined in each end and a shoulder formed on each end. An attachment bar attached to the support bar and two springs respectively mounted around each end of the support bar. The spring abuts the shoulder of the support bar. Two swing arms each with a pivot ring pivotally mounted on opposite ends of the support bar and abutting the spring, and a pedal attached to the other end. A bolt with a head extending radially outward from one end is screwed into the threaded hole of the support bar to hold the swing arm and the spring in place.

11 Claims, 9 Drawing Sheets

LEG SWING EXERCISER FOR A WALKER

BACKGROUND OF THE INVENTION

1. Field of the Invention

The present invention relates to a leg swing exerciser, and more particularly to a swing exerciser for a walker that can be mounted on a handlebar tube or a seat post.

2. Description of Related Art

A conventional leg swing exerciser for a walker in accordance with the prior shown in FIG. 9 comprises an H-shaped base (70), a seat assembly, two leg swing assemblies and two handles.

The base (70) has a pivot (701) mounted near the front. The seat assembly includes a square seat post (72) mounted near the center of the base (70) and a seat (73) mounted on the top of the seat post (72).

Each of the two leg swing assemblies is pivotally attached to opposite sides of the seat post (72). Each leg swing assembly includes two parallel swing arms (75) pivotally attached thereto. Each of the two parallel swing arms (75) has an upper end pivotally attached to pivot posts (74) near the top of the seat post (72) and a pedal (77) pivotally attached to the distal end.

Two handles (71) are pivotally attached to the pivot (701) extending up from the base (70). One end of a linkage (76) is pivotally attached to the lower end of each handle (71) and the other end is pivotally attached to the corresponding pedal (77).

In operation, a user stands on the pedals (77) and holds the handles (71) to exercise by moving the pedals (77) and the handles (71) back and forth.

The conventional leg swing exerciser for a walker as described above has several disadvantages.

1. The conventional leg swing exerciser for a walker is big and is hard to move after assembly. It can't be used whenever and wherever necessary.

2. It is difficult for a user to assemble. The conventional leg swing exerciser for a walker has many pivotal joints so that the assembly is complex.

3. The pedals of the conventional leg swing exerciser for a walker are attached to a parallel swing arm assembly so that the pedal is always horizontal. It will make the ankle joint uncomfortable after extended use. Furthermore it may cause injury to the user.

The present invention has arisen to mitigate and/or obviate the disadvantages of the conventional leg swing exerciser for a walker.

SUMMARY OF THE INVENTION

In accordance with one aspect of the present invention, a leg swing exerciser for a walker includes a T-shaped attachment bar with a swing arm pivotally mounted on each end. Each of the swing arms includes a pedal pivotally attached to the free end. Users can stand on the pedals to exercise their legs by swinging them.

Further benefits and advantages of the present invention will become apparent after a careful reading of the detailed description with appropriate reference to the accompanying drawings.

DETAILED DESCRIPTION OF THE INVENTION

Figure 1:
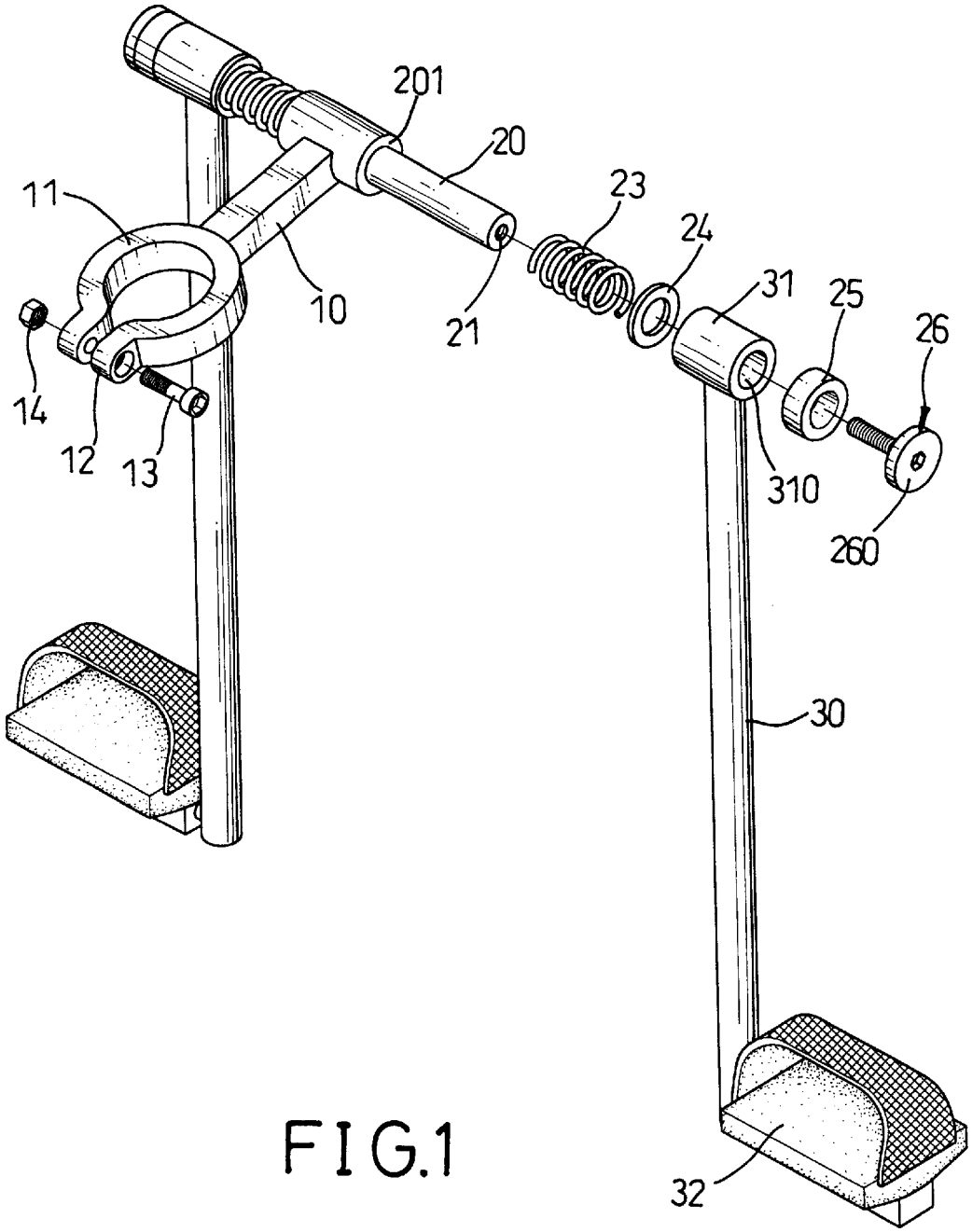
FIG. 1 is an exploded perspective view of a leg swing exerciser for a walker in accordance with the present invention.

Referring to the drawings and initially to FIG. 1, a leg swing exerciser for a walker in accordance with the present invention comprises a attachment bar (10), a support bar (20) attached to the attachment bar (10) and two swing arms (30) each pivotally mounted on the support bar (20).

The attachment bar (10) has a C-shaped clamp (11) formed on the free end. The clamp (11) has a lug (12) extending from each end and aligning with each other. Each of the lugs (12) has a hole (not numbered) to allow a bolt (13) to extend through the holes and connect the two lugs (12) with a nut (14) screwed onto the bolt (13).

The support bar (20) is horizontal and includes a shoulder (201) formed on both sides of the attachment bar (10) and a threaded hole (21) defined in each end of the support bar (20). A springs (23) mounted around each end of the support bar (20) abut the shoulders (201) of the support bar (20). A washer (24) is mounted on the support bar (20) on the outside end of each spring (23).

Each of the swing arms (30) has a pivot ring (31) formed at one end and a pedal (32) attached to the other end. The pivot ring (31) of each swing arms (30) has a hole (310) to allow the support bar (20) to extend through the pivot ring (31) and is inserted on the support bar (20) to abut the washer (24). A resilient ring (25) is mounted around the end of each support bar (20) and abuts the outside end of the pivot ring (31) of the swing arm (30). An adjusting bolt (26) with a head (260) is screwed into each of the threaded holes (21) at the end of the support bar (20) and the head (260) abuts the outside end of the resilient ring (25).

These adjusting bolts (26) can adjust the friction drag between the shoulder (201), the spring (23) and the pivot ring (31) to make the leg swing exerciser more suitable for a user. All the parts of the leg swing exerciser are held in place by these two adjusting bolts (26) so it is easy to assemble and to attach. The leg swing exerciser for a walker in accordance with the present invention is a convenient design for ordinary customers.

Figure 2:
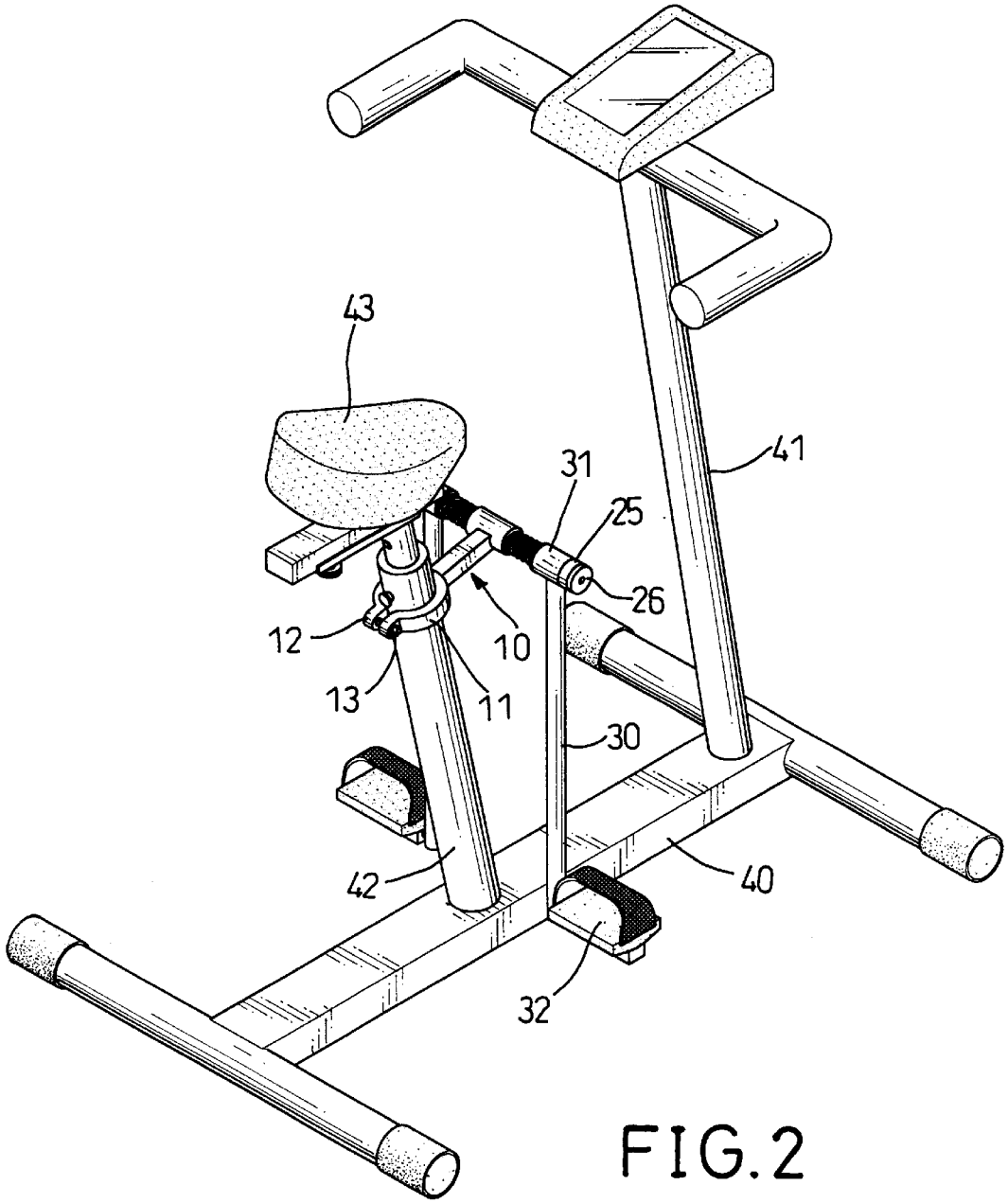
FIG. 2 is a perspective view of the leg swing exerciser for a walker in FIG. 1 mounted on a seat post.

With reference to FIG. 2, a first embodiment of the leg swing exerciser for a walker has an H-shaped base (40) with a handlebar tube (41) attached to the front portion and a seat post (42) attached near the center. The C-shaped clamp (11) on the attachment bar (10) is mounted around the seat post (42) and held in place by the bolt (13) and the nut (14). A seat (43) is attached to the free end of the seat post (42).

Figure 3:
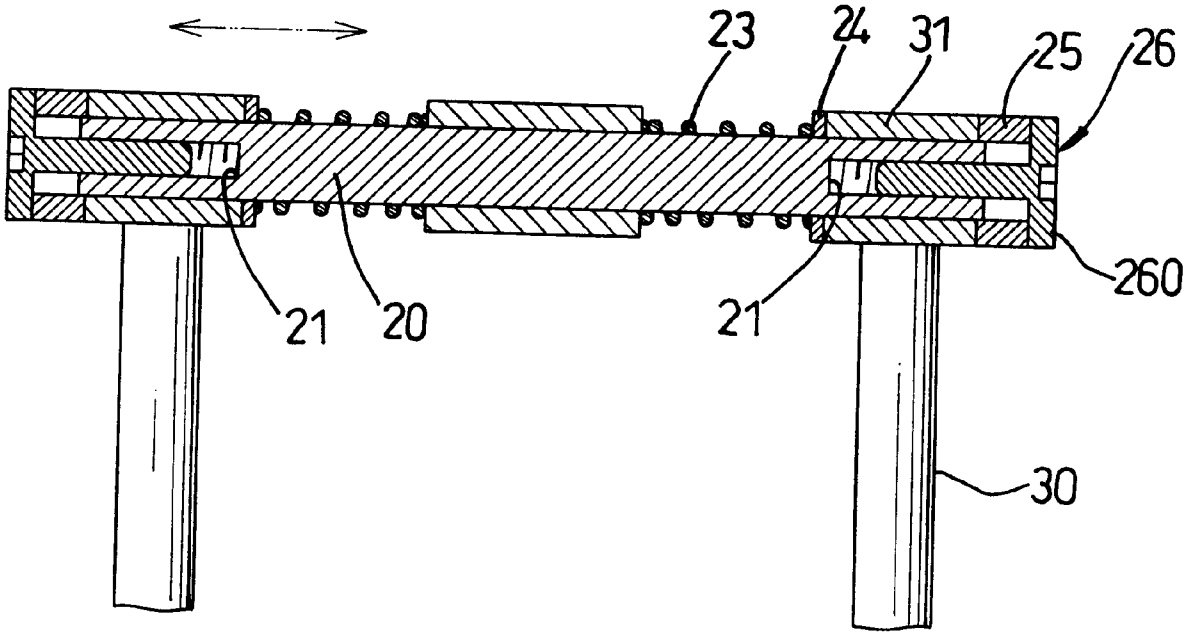
FIG. 3 is a front plan view in partial section of the leg swing exerciser in FIG. 1.

With reference to FIG. 3, the two adjusting bolts (26) are tightened or loosened to adjust the friction drag between the shoulder (201), the spring (23) and the pivot ring (31). The friction drag becomes greater when the adjusting bolt (26) is screwed deeper into the threaded hole (21). When the adjusting bolt (26) is unscrewed, the friction drag becomes less.

Figure 4:
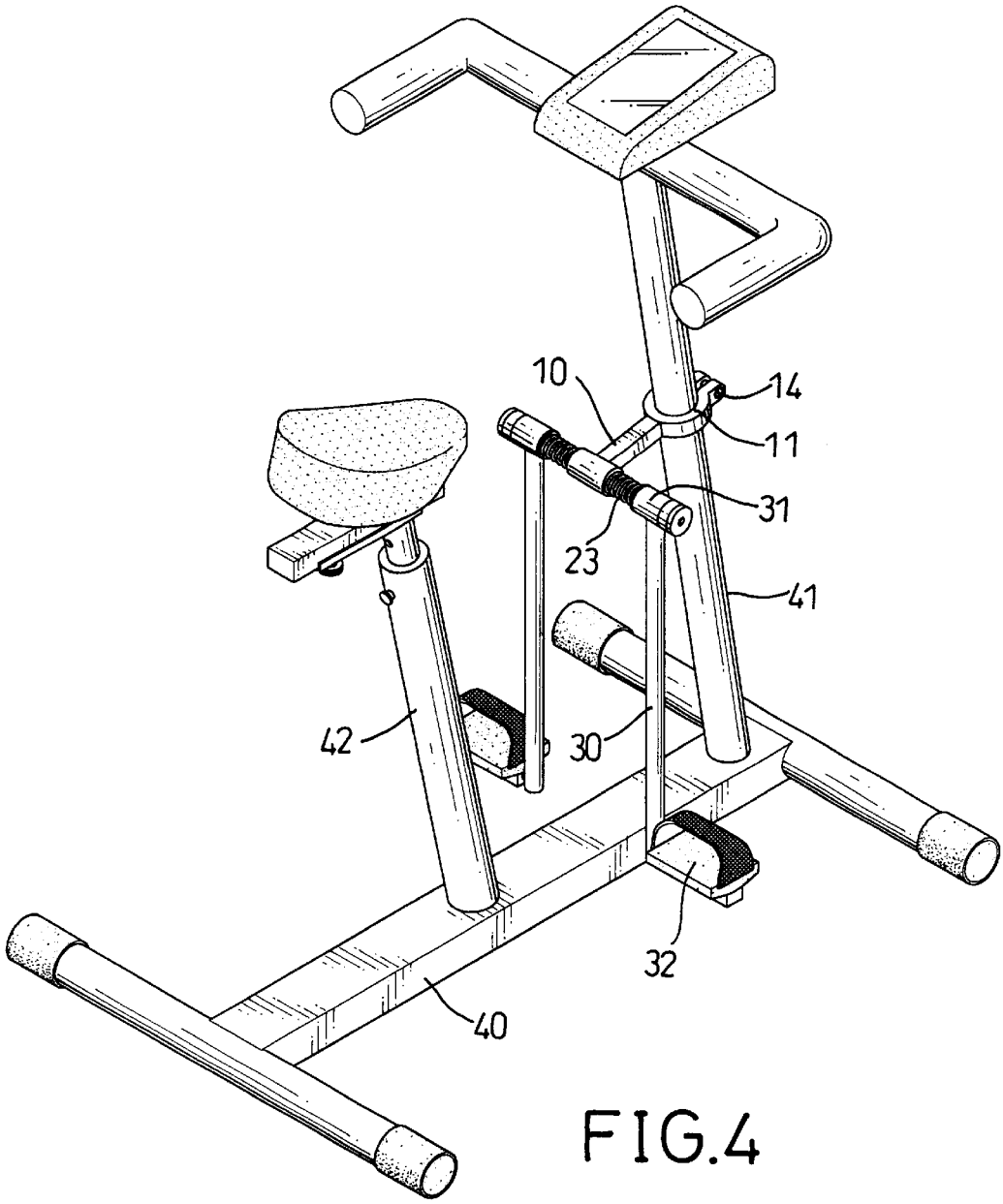
FIG. 4 is a perspective view of the leg swing exerciser in FIG. 1 mounted on a handlebar post of a walker.

With reference to FIG. 4, the leg swing exerciser for a walker as shown in FIG. 2 and the C-shaped clamp (11) on the attachment bar (10) are mounted around the handlebar tube (41) and held in place by the bolt (13) and the nut (14).

Figure 5:
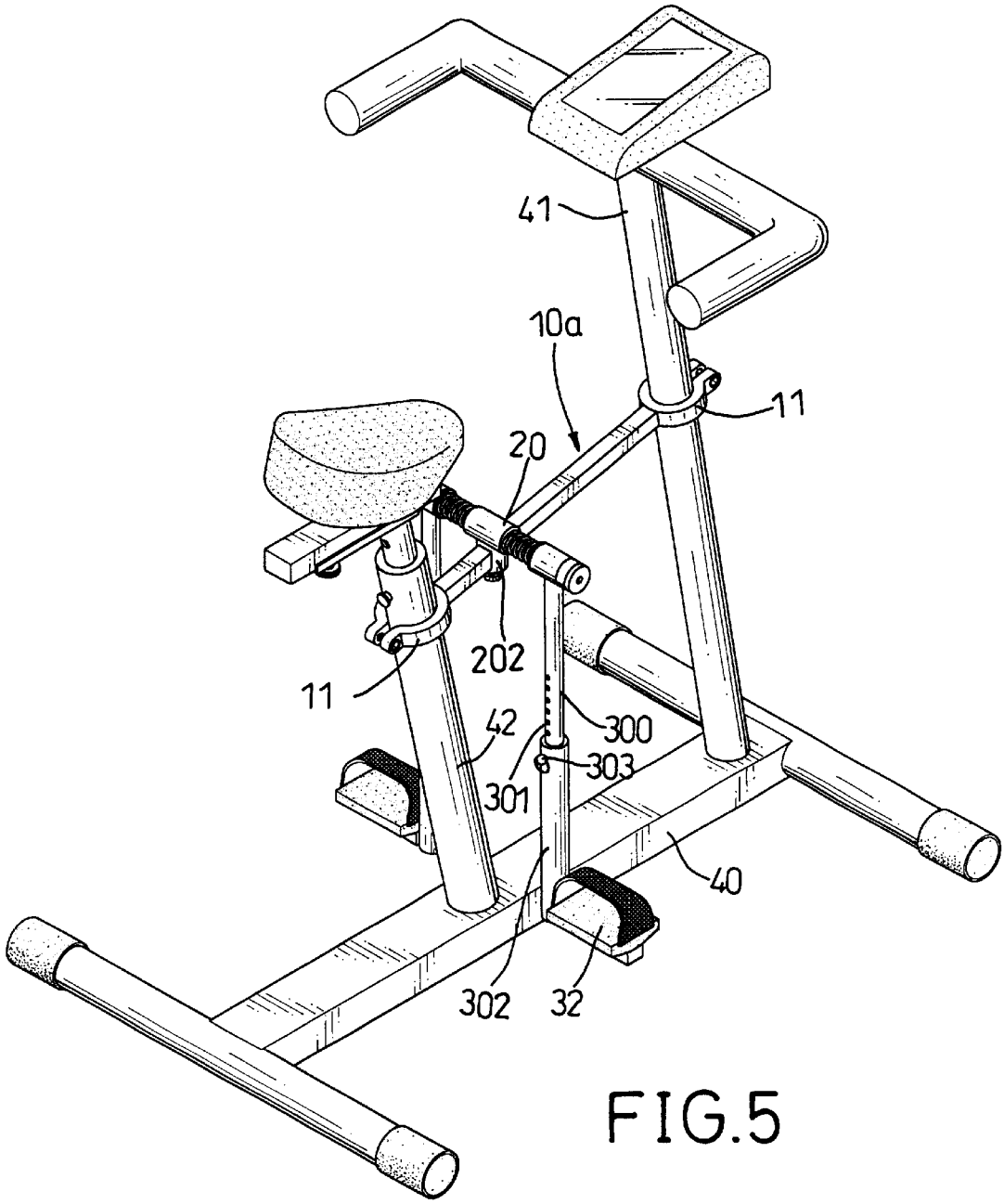
FIG. 5 is a perspective view of second embodiment of the leg swing exerciser for a walker in accordance with the present invention.

With reference to FIG. 5, a second embodiment of the leg swing exerciser for a walker also has an H-shaped base (40) with a handlebar tube (41) attached to the front and seat post (42) attached near the center. However, the modified attachment bar (10*a*) includes a C-shaped clamp (11) formed on each end. These two clamps (11) are respectively mounted around the seat post (42) and the handlebar tube (41). The support bar (20) is slidably mounted on the modified attachment bar (10*a*) and includes a block (202) extending down from the bottom of the support bar (20) having a receiving hole (not numbered) to receive the attachment bar (10*a*). The support bar (20) is held in place by a locking nut (not shown). The swing arm (300) has multiple holes (301) defined therein and an adjusting sleeve (302) forming the free end of the swing arm (300). The adjusting sleeve (302) has a locking piece (303) penetrating the adjusting sleeve (302) and received in one of the multiple hole (301) to adjust the total length of the swing arm (300) and the adjusting sleeve (302).

Figure 6:
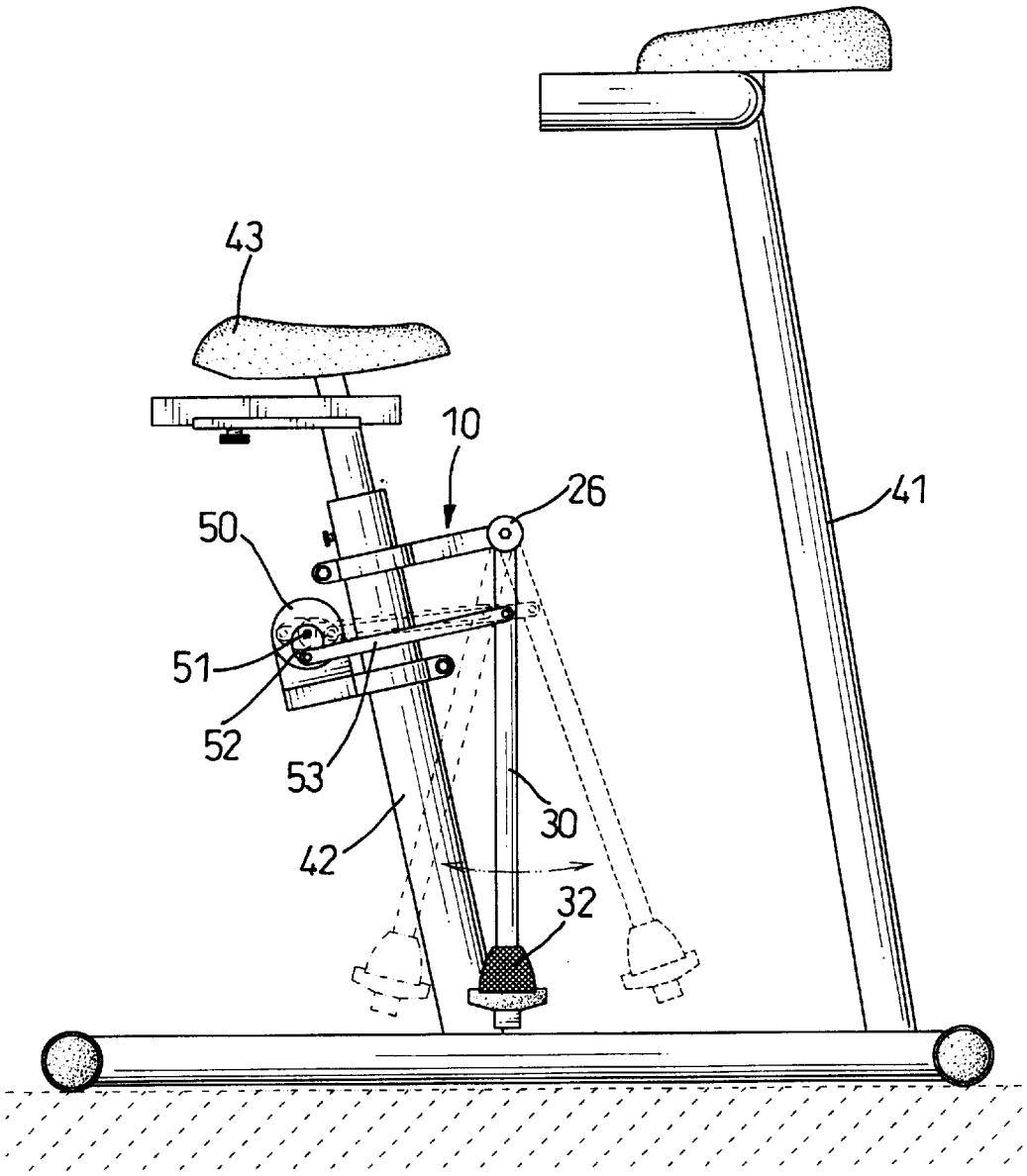
FIG. 6 is an operational side plan view of third embodiment of the leg swing exerciser for a walker in accordance with the present invention.

With reference to FIG. 6, a third embodiment of the leg swing exerciser for a walker has a motor (50) attached to the seat post (42). The motor (50) has a shaft (51) with two eccentric wheels (52) attached to opposite ends rotated by the motor (50). A crank (53) is attached to each of the eccentric wheels (52) with the other end attached to the swing arms (30) to make the swing arms (30) moved back and forth in opposed directions.

Figure 7:
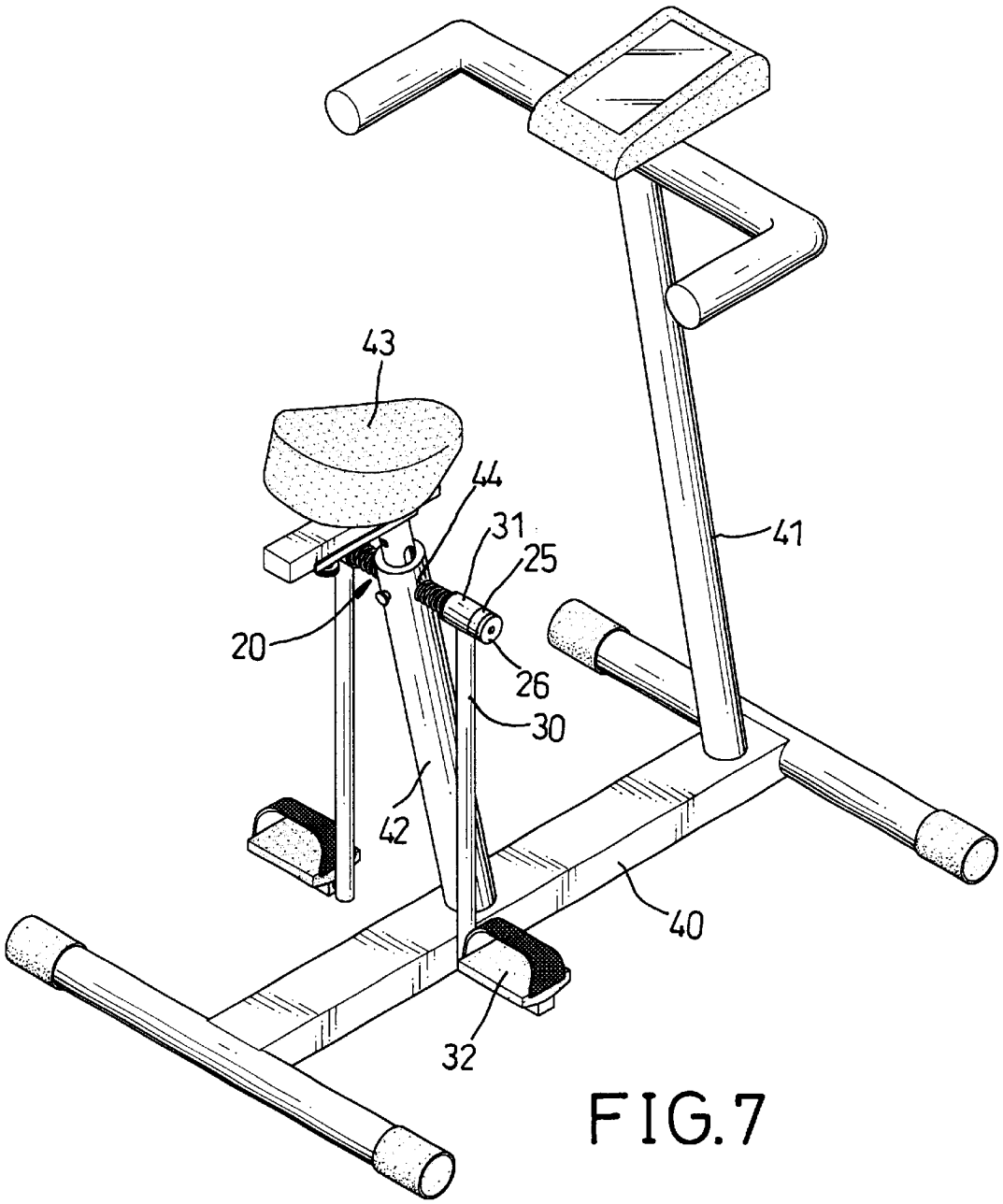
FIG. 7 is a perspective view of fourth embodiment of the leg swing exerciser for a walker in accordance with the present invention.

With reference to FIG. 7, a fourth embodiment of the leg swing exerciser for a walker does not have the attachment bar (10) and the shoulder (201) on the support bar (20). The support bar (20) penetrates the seat post (42) and the two springs (23) abut the seat post (42) rather than the shoulder (201).

Figure 8:
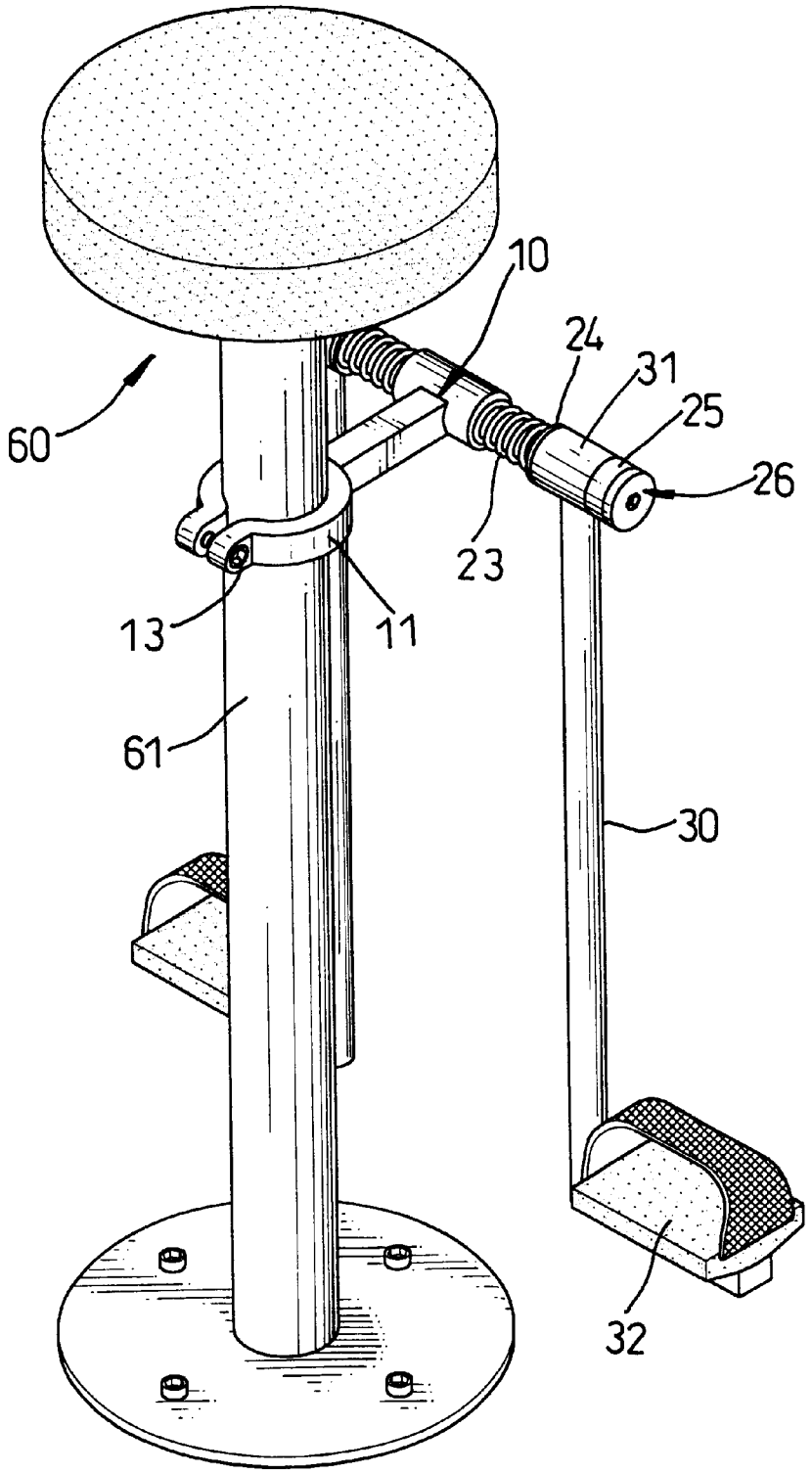
FIG. 8 is a perspective view of the leg swing exerciser for a walker in FIG. 1 attached to a stool post.
Figure 9:
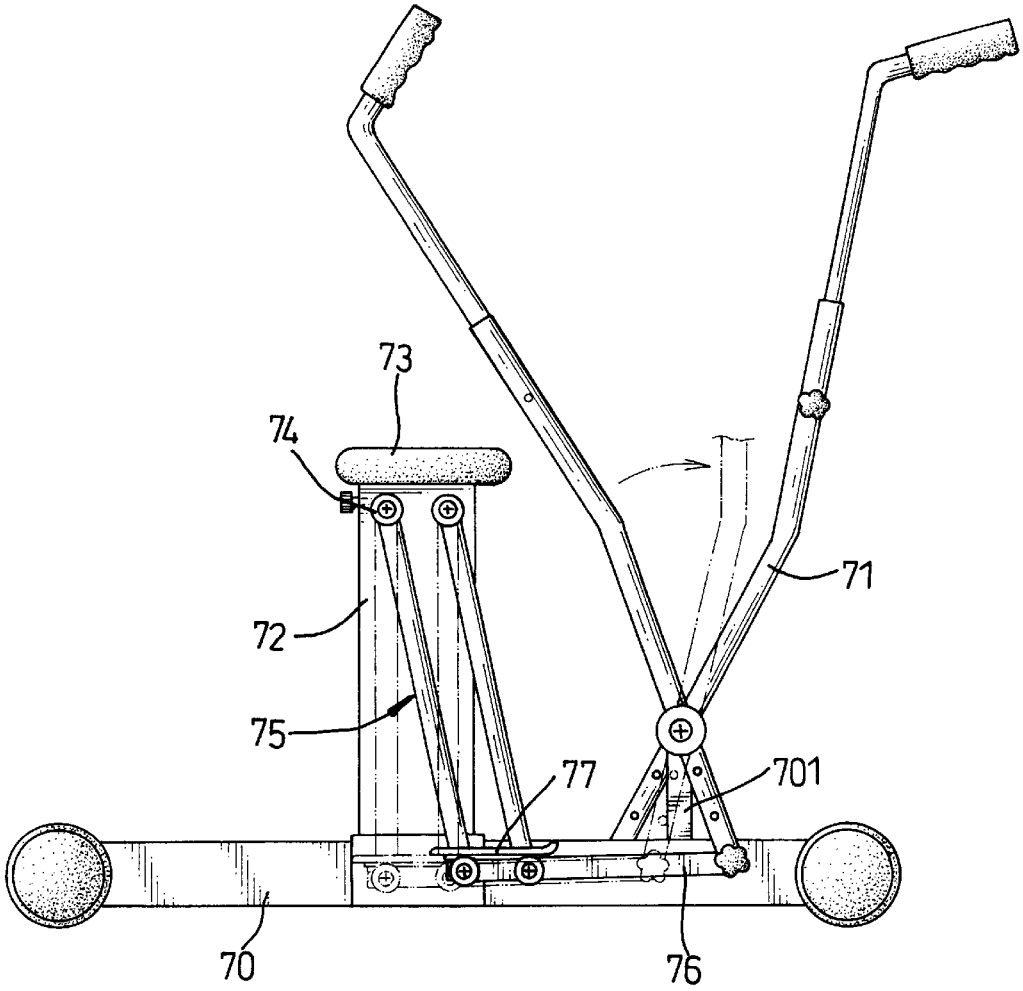
FIG.9 PRIOR ART
FIG. 9 is an operational side plan view of a conventional leg swing exerciser for a walker in accordance with the prior art.

With reference to FIG. 8, the leg swing exerciser for a walker can be used without the conventional frame assembly. The leg swing exerciser as shown in FIG. 1 can be attached to the main post (61) of stool (60) securely mounted to the ground or floor.

Although the invention has been explained in relation to its preferred embodiment, it is to be understood that many other possible modifications and variations can be made without departing from the spirit and scope of the invention as hereinafter claimed.

What is claimed is:

1. A leg swing exerciser for a walker comprising:

a support bar with a threaded hole defined in each end, said support bar having a shoulder formed on each end;

an attachment bar attached to said support bar;

a spring mounted around each end of said support bar, said springs abutting said shoulders of said support bar;

two swing arms with a pivot ring on one end pivotally attached to said end of each support bar and abutting said spring, and a pedal attached to the other end; and a bolt with a head extending radially out from one end screwed into said threaded hole of said support bar to hold said swing arm and said spring in place.

2. The leg swing exerciser for a walker as claimed in claim 1, wherein said attachment bar includes one end attached to said support bar and a C-shaped clamp formed on the other end.

3. The leg swing exerciser for a walker as claimed in claim 1, wherein said support bar includes a block extending therefrom near the center, said block having a receiving hole defined therein to receive said attachment bar, said support bar being held by a locking nut.

4. The leg swing exerciser for a walker as claimed in claim 3, wherein said attachment bar includes a C-shaped clamp formed on each end.

5. The leg swing exerciser for a walker as claimed in claim 2, wherein said C-shaped clamp includes a lug extending from each end, each of said lugs having a hole to allow a bolt to penetrate and said bolt having a nut attached thereto.

6. The leg swing exerciser for a walker as claimed in claim 5, wherein said swing arm is an expansion link.

7. The leg swing exerciser for a walker as claimed in claim 1, wherein said pivot ring includes a hole to allow said support bar to extend therethrough.

8. The leg swing exerciser for a walker as claimed in claim 1 further comprising two washers respectively mounted around said support bar and between said spring and said pivot ring of said swing arm.

9. The leg swing exerciser for a walker as claimed in claim 1 further comprising two resilient rings respectively mounted around said support bar outside of the pivot ring and abutted by said head of said bolt.

10. The leg swing exerciser for a walker as claimed in claim 4, wherein said C-shaped clamp includes a lug extending from each end, each of said lugs having a hole to allow a bolt to penetrate and said bolt having a nut attached thereto.

11. The leg swing exerciser for a walker as claimed in claim 10, wherein said swing arm is an expansion link.

* * * * *